US005688059A

United States Patent [19]

Clarke et al.

[11] Patent Number: 5,688,059

[45] Date of Patent: Nov. 18, 1997

[54] REGISTRATION OF PAPER LOCATION FOR MULTIPLE PRINTING

[75] Inventors: Cyrus Bradford Clarke; David Brian Langer, both of Lexington; Randall David Mayo, Georgetown; Gregory John Sherwood, Lexington, all of Ky.

[73] Assignee: Lexmark International, Inc., Lexington, Ky.

[21] Appl. No.: 717,392

[22] Filed: Sep. 20, 1996

[51] Int. Cl.[6] ..... B41J 13/26

[52] U.S. Cl. ..... 400/578; 400/703; 400/709; 271/227

[58] Field of Search ..... 400/706, 703, 400/709, 709.2, 605, 578, 581; 226/45; 347/101, 104, 218; 271/258, 265, 226, 227

[56] References Cited

U.S. PATENT DOCUMENTS 4,734,868 3/1988 DeLacy ..... 364/519

4,898,488 2/1990 Yokoi et al. ..... 400/605

*Primary Examiner*—Christopher A. Bennett

*Attorney, Agent, or Firm*—John A. Brady

[57] ABSTRACT

A laser printer (3) can initiate a line of printing only when the sweep of the laser light reaches a point in its cycle. An inkjet printer (5) moves paper by stepper motor in increments. Switch (9) senses the paper (15) to determine the location of paper in path (6) with respect to nominal printing locations of the laser printer. The closest nominal position is selected for printing. The paper may lead or lag the selected position. Switch (11) senses the paper to determine the location of paper in the path with respect to nominal printing locations of the inkjet printer. Two leads are added to reach a net greater lead, a lag is subtracted from a lead, and two lags are added to reach a net greater lag. The closest nominal position is then selected. This assures that registration does not vary by more than one half of the spacing between nominal locations of the second printer.

7 Claims, 2 Drawing Sheets

REGISTRATION OF PAPER LOCATION FOR MULTIPLE PRINTING

TECHNICAL FIELD

This invention relates to the feeding of paper between two or more printers or other imaging devices with accurate location of the paper for printing combined images by the two or more devices. Such printing might be black from a laser printer and color to highlight the black from an inkjet printer. Such printing might also be three color printing by separate printers for each color.

BACKGROUND OF THE INVENTION

The locating of paper or other media is typically by simply sensing the presence of the medium. In some systems, such as U.S. Pat. No. 4,734,868 to DeLacy, a mark on the paper is sensed. This invention senses the forward edge of the paper, which is conventional. However, in accordance with this invention the paper is sensed near each printer and an adjustment is made to compensate for the locations of actual printing which depend on the cycle characteristics of each printer.

DISCLOSURE OF THE INVENTION

In its broadest sense, this invention involves selecting the closest nominal position for printing using a sheet location sensor and data processing apparatus.

In accordance with this invention two or more printers are employed. The printers can initiate printing only at given points in an operating cycle. In an embodiment, the first printer is a laser printer, which has an optical system having a mirror continuously rotating at a constant speed to provide a sweep of light across a photosensitive member. A line of printing can only be initiated when that sweep begins, and lines of printing are separated by a fixed distance set by paper movement between laser sweeps. A second printer is an inkjet printer in which the paper is moved in increments of a stepper motor, with printing being by a printhead which sweeps across paper while the stepper motor is not moving paper. Lines of printing are separated by a fixed distance set by the paper movement by one increment of the stepper motor. The objective is to highlight with color certain printing from the laser printer or to add color graphics, with the second printing (typically color by the inkjet printer) being accurately located with respect to the black printing from the laser printer.

The start of optical sweep to print a line in a laser printer is identified by a standard signal. The start of a paper feed increment by a stepper motor is identified by the initiation of the signal activating the stepper motor. In accordance with this invention, if the location of paper to be printed is sensed for the first printer to be forward or back of a nominal location, that difference is stored. When the location of printing is sensed for the second printer, a forward displacement from nominal is subtracted from a rear displacement from nominal and vice versa, to define the position of the paper in the second printing. If a third printer is employed the displacement of the first printer is added or subtracted from the sensed paper position of the third printer. Thus, all adjustments to registration are made with respect to one printer, and, therefore, none of the adjustments can vary more that one-half of the distance between lines of the second or subsequent printer.

BRIEF DESCRIPTION OF THE DRAWINGS

The details of this invention will be described in connection with the accompanying drawing in which.

BEST MODE FOR CARRYING OUT THE INVENTION

Figure 1:
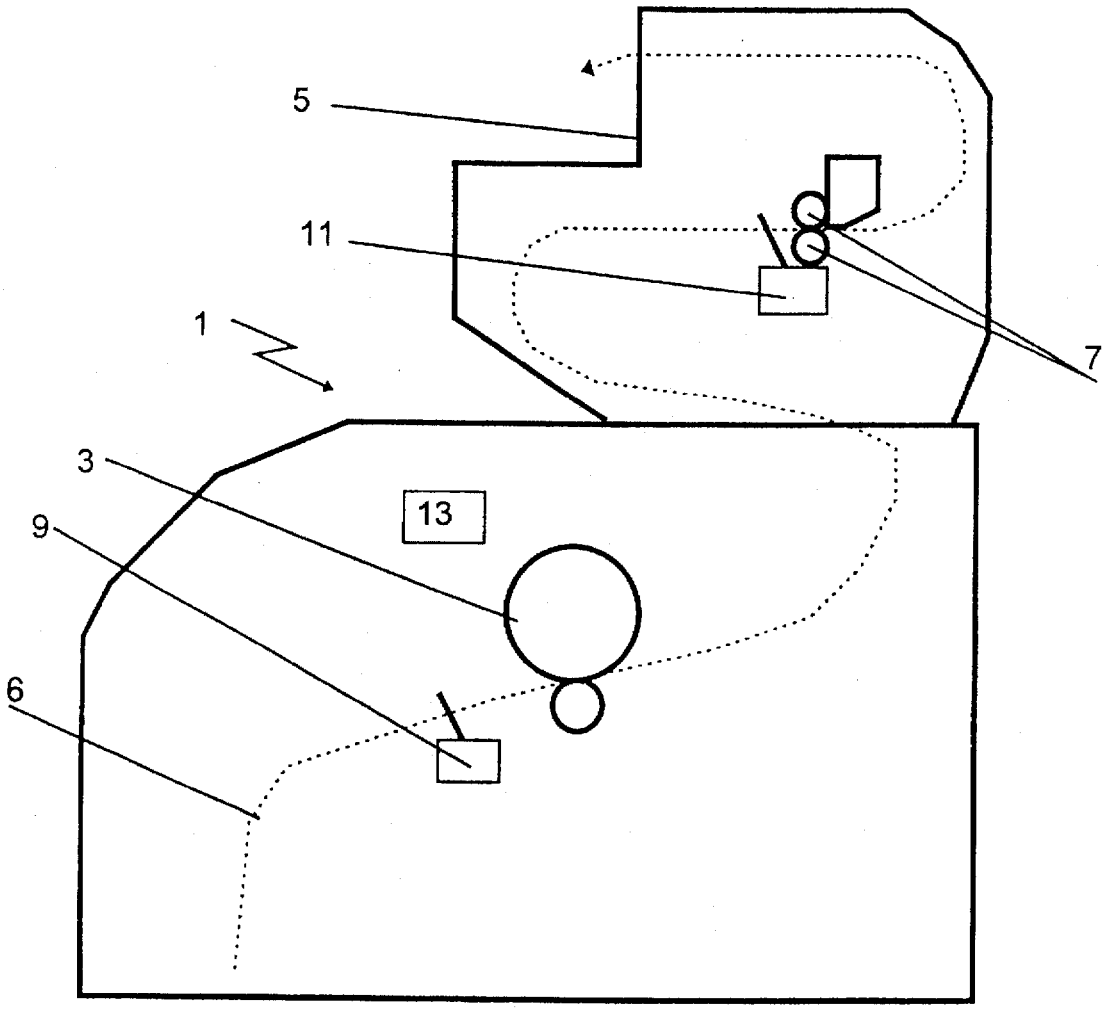
FIG. 1 is illustrative of a preferred printing system and FIGS. 2*a* and FIG. 2*b* are illustrative of the physical relationship determined in accordance with this invention.

FIG. 1 illustrates a dual printing system 1 to which this invention is directed. The system has a laser printer station 3 and an inkjet printer station 5 with a paper path 6 joining them to transport paper or other media. Laser printer 3 has high inertia mechanisms and therefore continuously moves paper during printing. Inkjet printer 5 moves the paper incrementally by mechanism shown illustratively as pinch rollers 7, with printing done while the paper is stopped.

As close as practical to the printing operation of laser printer 3 is a paper presence switch 9. Similarly, as close as practical to the printing operation of inkjet printer 5, is a second paper presence switch 11. Except for the switches 9 and 11 as employed in the invention, laser printer 3 and inkjet printer 5 may be entirely conventional and therefore will not be further illustrated or described in detail.

Because the paper delivery mechanism cannot maintain precise positional control as it moves the page within the printer 1, the paper must be re-registered as it reaches each printing stage 3 and 5. In both the laser printer 3 and the inkjet printer 5, this registration consists of moving one side of the paper against a registration edge to remove page skew and to set the paper at a fixed location in the dimension perpendicular to paper travel. To the degree of precision this operation is successful, the only remaining uncertainty to establishing the exact location of the page is the determination of the top-of-paper. Switches 7 and 9 are high precision switches, which are generally available, and so locate the top-of paper with high precision. However, the location of printing depends on where the printers 3 and 5 actually begin printing.

Laser printer 3 has a scanning mirror motor which spins the mirror at constant speed, and a paper transport system which, due to its inertia, must be maintained at a constant speed while moving paper through laser printer 3. As is conventional, the start of the optical sweep for each line of printing of laser printer 3 is signaled by a signal from the optical system, often denominated HSYNC. The time relationship between HSYNC and the sensing of the front edge of paper by switch 7 defines the location of printing with respect to a central nominal location. This nominal location is that where printing would occur under ideal circumstances. Nominal locations preceding and following the central nominal location differ by the period between HSYNC signals.

Inkjet printer 5 employs a stepper motor (not shown) to advance the paper by rotating pinch rollers 7. This moves paper in integral movements. Printing is conducted when the paper is stopped. Accordingly, the operating cycle of inkjet printer 5 causes printing only on lines defined by the pinch roller 7 being stopped. Such lines of printing are equally spaced because the distance between such lines is the amount of movement of paper by one operation of the stepper motor which rotates pinch rollers 7. As sensor 11 senses the top of paper being fed into inkjet printer 5, the position of that paper may correspond to a location including and leading or lagging a central location. For registration with printing from laser printer 3, paper which is at a predetermined point in the scan cycle of printer 3 when first sensed by sensor 9 of laser printer 3 should be at the corresponding point in the paper feed cycle of inkjet printer 5 when first sensed by sensor 11.

Figure 2A:
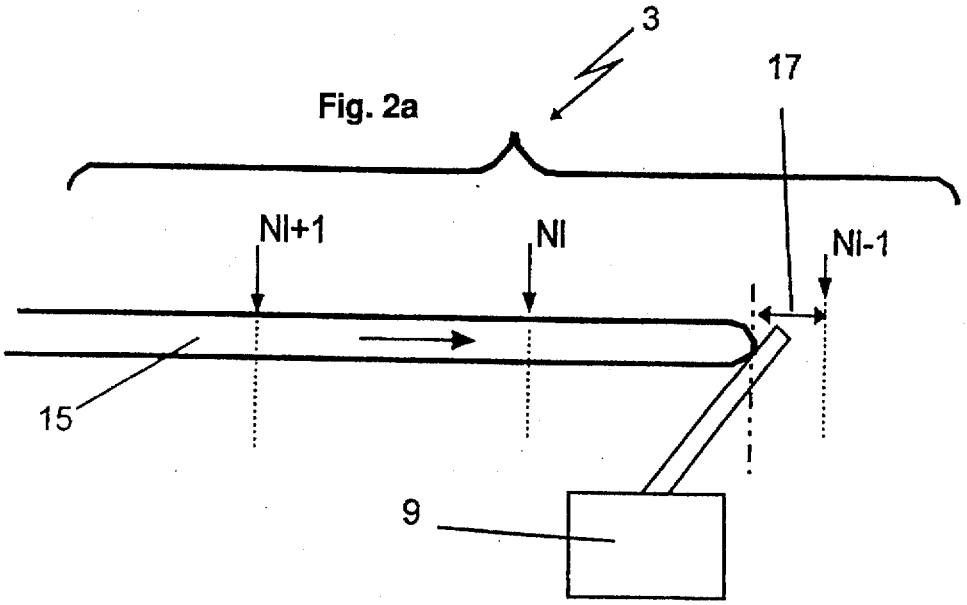

Referring to FIG. 2*a*, the location at which printing of a line would occur for laser printer 3 is illustrated with three such points denominated N1 N1+1 and N1−1. N1 is the central nominal location where printing would occur under ideal circumstances. When paper is first sensed by sensor 9, it may be at any position within three such printing locations, N1, N1+1, and N1−1. It is standard for the control microprocessor 13 (FIG. 1) of the printer to determine the next nominal location after paper is sensed (a fixed number of HYSYNC signals are sensed and then printing is begun). In accordance with this invention microprocessor 13 determines the difference between the location of the sensed paper and the closest of the potential printing locations, N1, N1+1, or N1−1. The closest one of N1, N1+1, or N1−1 is that selected for printing.

That standard operation is conducted with this invention for the first printer, laser printer 3, and the displacement from the nominal selected is stored in microprocessor 13. As shown in FIG. 2*a*, paper 15 is moved left to right with the nominal locations represented by arrows N1−1, N1, and N1+1 being those at which printing on paper 15 can occur. If paper 15 is ahead of a nominal position by more than one-half of the spacing between the N1 positions, selection would be to print at the N1−1 position, and if it is behind a nominal position by more than one-half of the spacing between the N1 positions, selection would be to print at the N1+1 position.

In FIG. 2*a* the paper 15 shown leads the central nominal position, N1, by more than one-half of the spacing between adjoining nominal positions. Accordingly, the closest position is N1−1 and that is selected as the printing location by microprocessor 13, as is standard. With respect to the selected location, N1−1, paper 15 lags, shown by numeral 17. In accordance with this invention, the fact of the lag and the actual distance of the lag is stored by microprocessor 13.

The paper 15 is then advanced to the inkjet printer 5 to be printed. Once again, the paper 15 may be at a range of locations with respect to nominal, although the center nominal position Ni is the location of printing under ideal conditions. Nominal locations preceding and following the central nominal location, Ni, differ by the amount of movement of paper 15 with one stepper motor operation of pinch rollers 7.

Figure 2B:
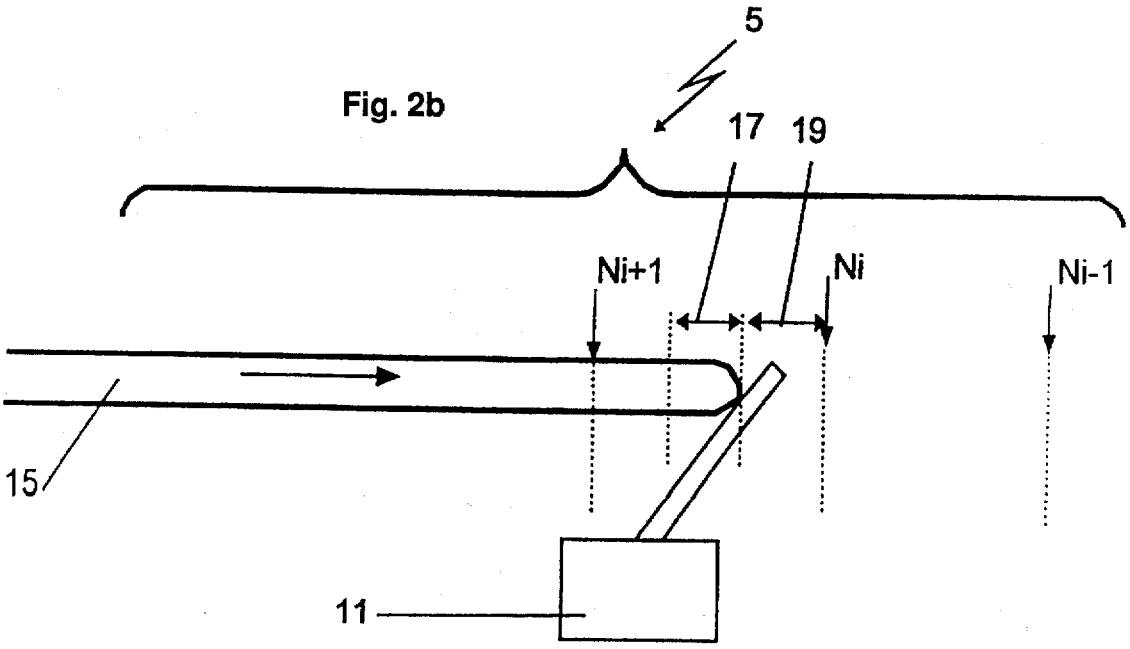

In FIG. 2*b* the paper 15 is shown lagging the Ni location, shown by numeral 19, but by less than one-half of the distance between adjoining Ni positions. However, when the lag distance 17 from the laser printer 3 is added, the total is closer to Ni+1 than to Ni. Microprocessor 13 makes this computation and selects Ni+1 as the location for printing.

The computation by microprocessor 13 adds leads to reach a net greater lead, subtracts lags from leads, and adds lags to reach a net greater lag. Microprocessor 13 selects the closest nominal position based on this net lead or lag.

Exact registration of paper 15 with N1 and Ni is the nominal design of the system, and therefore the most probable location of paper 15. Such exact registration occurs when the front edge of paper 15 closes switch 9 exactly at the N1 time, indicated by the N1 arrow in FIG. 2*a*, and when the front edge of paper 15 closes switch 11 exactly at the Ni time, indicated by the Ni arrow in FIG. 2*b*. The actual position of paper 15 with respect to the nominal locations depends on random variations in actual operation. Where paper 15 leads by one-half of the nominal spacing at one printer 3 or 5 and lags by one-half of the nominal spacing of the other printer 3 or 5, and assuming for purposes of illustration that the nominal spacings are the same for both printers, then the two would cancel and the printing would be exact. In practice, however, exact registration rarely occurs, although this invention would foster it when the two differentials opposite in direction occur. This invention does assure that the registration does not vary by more than one half of the spacing between the nominal locations of the second printer.

Variations will be apparent. Patent coverage commensurate with this invention is sought, with particular reference to the accompanying claims.

What is claimed is:

1. A printing system comprising a printer having a cycle of operation separating printing by a first distance, media sensing means at said printer to sense the location of said media with respect to at least two nominal locations for printing of said media by said printer, and data processing apparatus for controlling said printing system to initiate printing by said printer at the closest of said nominal locations for printing based on information from said media sensing means, said data processing apparatus also determining the difference between said sensed location of said media and said closest nominal location, and storing said difference.

2. The printing system as in claim 1 in which said printer operates with continuous movement of said media.

3. The printing system as in claim 1 in which said printer operates with movement of said media in steps.

4. A printing system comprising a first printer having a cycle of operation separating printing by a first distance, a second printer having a cycle of operation separating printing by a second distance, a paper feed path to move paper or other sheet media to said first printer for printing by said first printer and then to said second printer for printing by said second printer, first media sensing means at said first printer to sense the location of said media with respect to a nominal location for printing of said media by said first printer, second media sensing means at said second printer to sense the location of said media with respect to a nominal location for printing of said media at said second printer, and data processing apparatus controlling said printing systems to: compute from information from said first media sensing means the lead or lag from nominal at said first printer, store said lead or lag at said first printer, compute from information from said second media sensing means the lead or lag from nominal at said second printer, compute the net lead or lag at said second printer by adding two leads to reach a net greater lead, by subtracting lags from leads, and by adding lags to reach a net greater lag, and select the nominal location for printing by said second printer based on said net lead or lag.

5. The printing system as in claim 4 in which said first printer is a printer which operates with continuous movement of said media.

6. The printing system as in claim 5 in which said data processing apparatus initiates printing by said first printer at the closest of a said nominal location for printing by said first printer based on information from said first media sensing means.

7. The printing system as in claim 4 in which said data processing apparatus initiates printing by said first printer at the closest of a said nominal location for printing by said first printer based on information from said first media sensing means.

* * * * *